US006430948B2

(12) United States Patent
Okubo

(10) Patent No.: US 6,430,948 B2
(45) Date of Patent: Aug. 13, 2002

(54) AUTOMATIC VENDING MACHINE CAPABLE OF CARRYING OUT A DEFROSTING OPERATION ADAPTED TO A FROSTING CONDITION

(75) Inventor: Masaru Okubo, Isesaki (JP)

(73) Assignee: Sanden Corporation (JP)

( * ) Notice: Subject to any disclaimer, the term of this patent is extended or adjusted under 35 U.S.C. 154(b) by 0 days.

(21) Appl. No.: 09/725,923

(22) Filed: Nov. 30, 2000

(30) Foreign Application Priority Data

Dec. 3, 1999 (JP) ..... 11-345056

(51) Int. Cl.[7] ..... F25D 21/06
(52) U.S. Cl. ..... 62/151; 62/155; 62/156
(58) Field of Search ..... 62/151, 155, 234, 62/156

(56) References Cited

U.S. PATENT DOCUMENTS 4,432,211 A * 2/1984 Oishi et al. ..... 62/155
4,573,326 A * 3/1986 Sulfstede et al. ..... 62/128
5,156,010 A * 10/1992 Inoue et al. ..... 165/240
5,385,265 A * 1/1995 Schlamp ..... 221/7
5,460,006 A * 10/1995 Torimitsu ..... 62/127
5,775,124 A * 7/1998 Park et al. ..... 62/408
5,816,054 A * 10/1998 Yoo et al. ..... 62/154
6,223,817 B1 * 5/2001 Oden et al. ..... 62/157

* cited by examiner

*Primary Examiner*—William E. Tapolcai
*Assistant Examiner*—Mohammad M Ali
(74) *Attorney, Agent, or Firm*—Banner & Witcoff

(57) ABSTRACT

In an automatic vending machine in which a number of items are stored in a commodity storage and cooled by a cooling unit included in a refrigerating circuit, a temperature sensor detects a storage temperature within the commodity storage to produce a temperature signal. Responsive to the temperature signal, a calculating unit calculates a temperature variation rate prior to a defrosting operation of a defrosting unit, which is intermittently carried out for the cooling unit. With reference to the temperature variation rate, a defrost control part controls the defrosting operation.

12 Claims, 4 Drawing Sheets

AUTOMATIC VENDING MACHINE CAPABLE OF CARRYING OUT A DEFROSTING OPERATION ADAPTED TO A FROSTING CONDITION

BACKGROUND OF THE INVENTION

This invention relates to an automatic vending machine for vending cooled or refrigerated commodities such as a canned beverage, a bottled beverage in a glass bottle or a PET (polyethylene terephthalate) bottle, and various food items.

Generally, an automatic vending machine of the type comprises a heat-insulating commodity storage arranged in a main body of the automatic vending machine. The commodity storage has a commodity receiving column disposed therein to receive a number of items to be sold. When a particular item is selected by a customer, the particular item is delivered or discharged to a commodity outlet. The automatic vending machine further comprises a refrigerating circuit having a cooling unit disposed in the commodity storage, and a fan for circulating internal air within the commodity storage. By circulating the internal air through the cooling unit, the items in the commodity storage are cooled.

In order to prevent frosting or to perform defrosting, the automatic vending machine carries out a defrosting operation in which a cooling operation by the cooling unit is interrupted and the fan is continuously operated. The defrosting operation may automatically be carried out for a preselected time period at a predetermined time interval. In this case, every defrosting operation is performed for the preselected time period which is fixed irrespective of a frosting condition, i.e., the amount of frost. If the amount of frost is great, the preselected time period is too short to perform sufficient defrosting. On the other hand, if the amount of frost is small, the defrosting operation is excessively carried out to decrease a cooling efficiency in the commodity storage. Thus, it is difficult to efficiently perform the defrosting operation adapted to the frosting condition.

SUMMARY OF THE INVENTION

It is therefore an object of this invention to provide an automatic vending machine which is for vending cooled or refrigerated commodities and is capable of carrying out a defrosting operation adapted to a frosting condition of a cooling unit.

Other objects of the present invention will become clear as the description proceeds.

According to the present invention, there is provided an automatic vending machine which comprises a commodity storage for storing a number of items to be sold, a refrigerating circuit having a cooling unit connected to the commodity storage for cooling the items, a defrosting unit connected to the cooling unit for intermittently carrying out a defrosting operation for the cooling unit, a temperature sensor connected to the commodity storage for detecting a storage temperature within the commodity storage to produce a temperature signal, a calculating unit connected to the temperature sensor and responsive to the temperature signal for calculating a temperature variation rate prior to the defrosting operation, and a defrost control part connected to the calculating unit and the defrosting unit for controlling the defrosting operation with reference to the temperature variation rate.

BRIEF DESCRIPTION 0F THE DRAWING

DESCRIPTION OF THE PREFERRED EMBODIMENT

Figure 1:
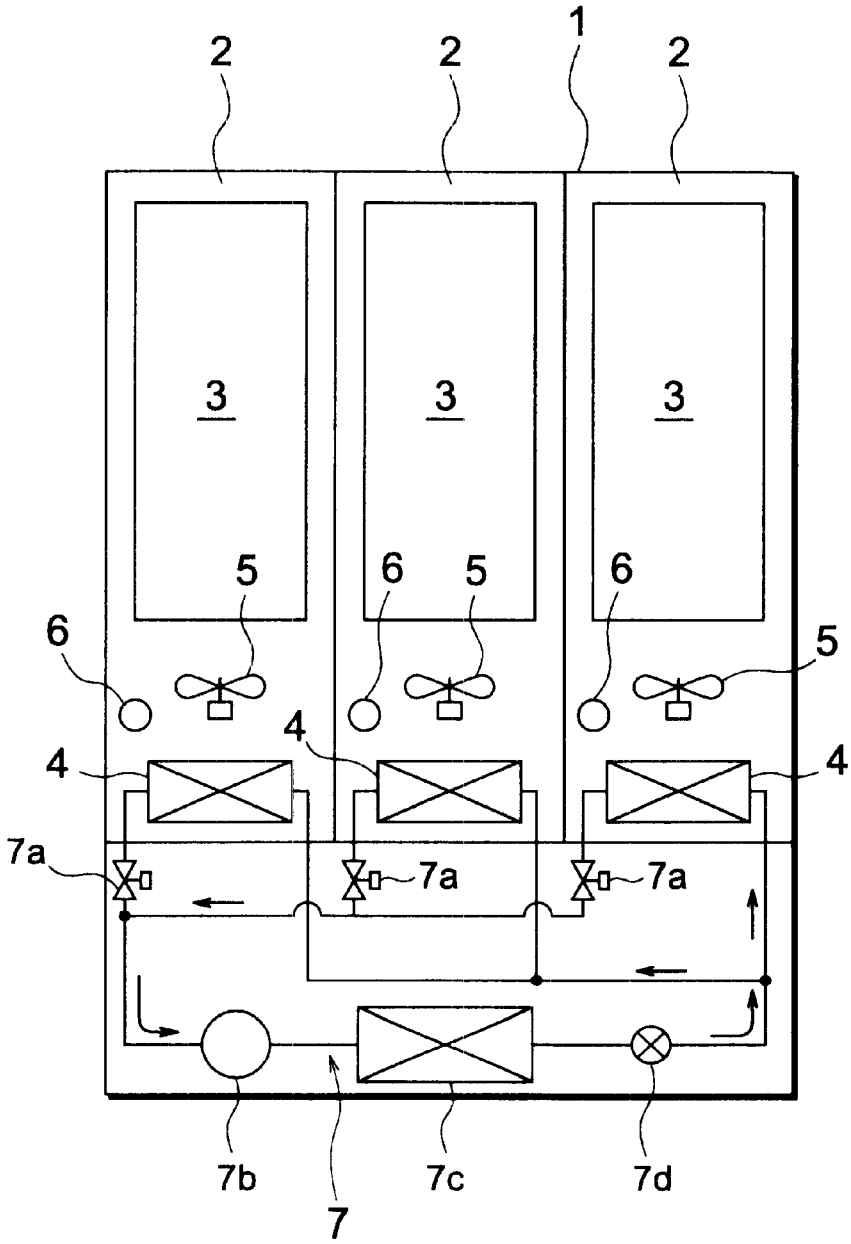
FIG. 1 is a schematic diagram showing an automatic vending machine according to one embodiment of this invention.
Figure 2:
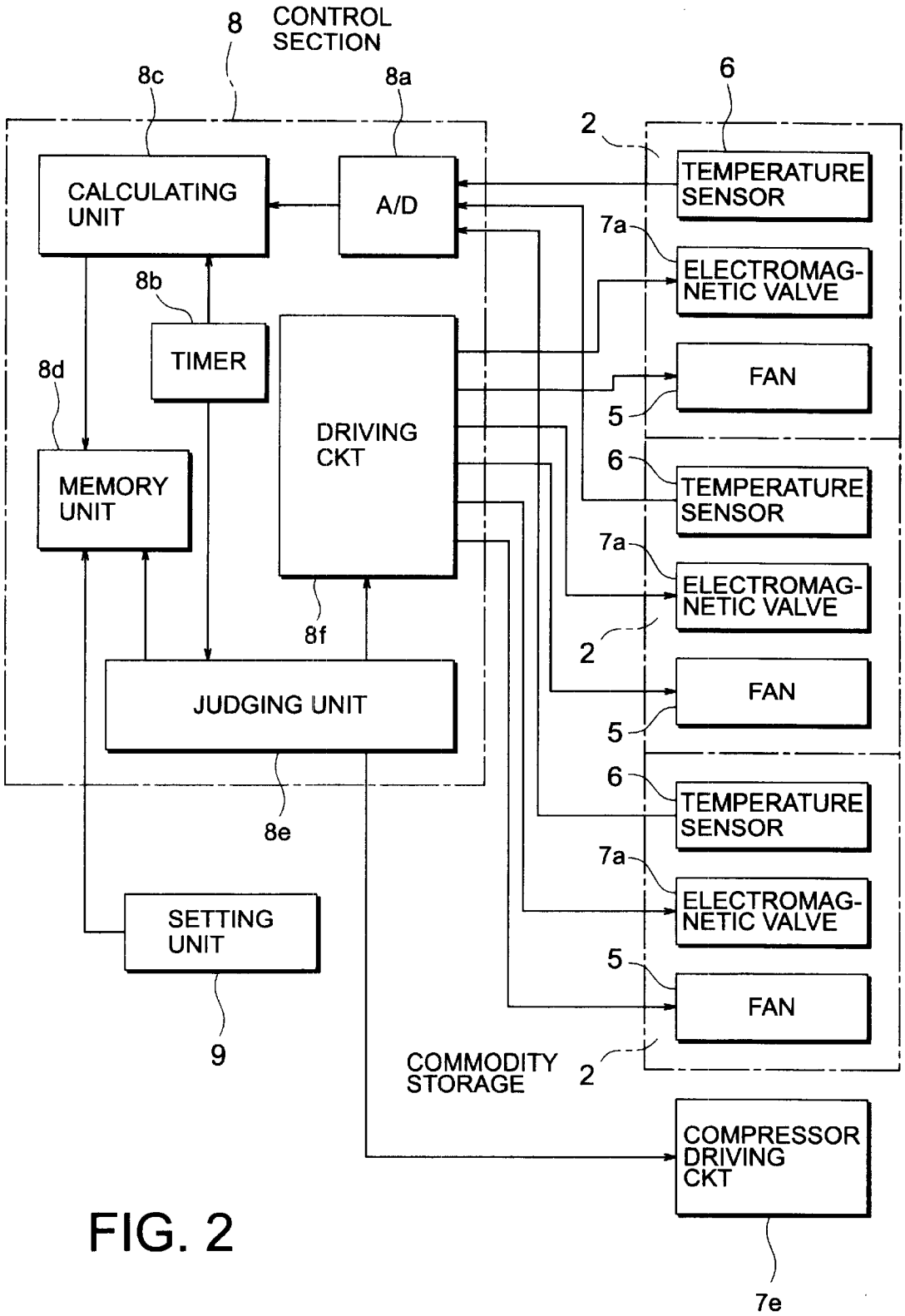
FIG. 2 is a block diagram of a control section of the automatic vending machine illustrated in FIG. 1.

Referring to FIGS. 1 and 2, description will be made of the structure of an automatic vending machine according to one embodiment of this invention.

The automatic vending machine comprises a main body 1 including a plurality of commodity storages 2 each of which has a heat-insulating structure and is for storing a number of items to be sold. In each of the commodity storages 2, a commodity receiving column 3 is disposed. Each commodity storage 2 has a cooling unit (evaporator) 4, a fan 5, and a temperature sensor 6 which are arranged inside of the commodity storage 2. The cooling unit 4 forms a part of a refrigerating circuit 7 connected to each commodity storage 2. In addition to the cooling unit 4, the refrigerating circuit 7 comprises a plurality of electromagnetic valves 7*a* in one-to-one correspondence to the commodity storages 2, a compressor 7*b*, a condenser 7*c*, and an expansion valve 7*d*. Each of the cooling units 4 has one end connected through a corresponding one of the electromagnetic valves 7*a* to a refrigerant suction side of the compressor 7*b*. The compressor 7*b* has a refrigerant discharge side connected to one end of the condenser 7*c*. The condenser 7*c* has the other end connected through the expansion valve 7*d* to the other end of the cooling unit 4.

At least one of the commodity storages 2 may be provided with a heater arranged inside. In this event, it is possible to select whether the interior of the commodity storage 2 is cooled by the cooling unit 4 or heated by the heater.

Referring to FIG. 2, the automatic vending machine further comprises a control section 8 responsive to a temperature signal representative of a detected temperature detected by each temperature sensor 6 for controlling each electromagnetic valve 7*a* of the refrigerating circuit 7 and each fan 5. The control section 8 comprises an A/D converter 8*a* supplied with the temperature signal from each temperature sensor 6, a timer 8*b* for producing a time signal, a calculating unit 8*c* responsive to the temperature signal supplied through the A/D converter 8*a* and the time signal from the timer 8*b* for calculating a temperature variation rate as a calculated temperature variation rate, a memory unit 8*d* for memorizing the calculated temperature variation rate and a predetermined reference rate, a judging unit 8*e* for judging the length of a defrosting time period with reference to the calculated temperature variation rate and the predetermined reference rate memorized in the memory unit 8*d*, and a driving circuit 8*f* for driving each electromagnetic valve 7*a* and each fan 5 with reference to the result of judgment in the judging unit 8*e*. The memory unit 8*d* is connected to a setting unit 9 for setting or selecting the predetermined reference rate. The judging unit 8*e* is connected to a compressor driving circuit 7*e* of the refrigerating circuit 7.

In the above-mentioned automatic vending machine, the refrigerating circuit 7 circulates a cool refrigerant through the cooling unit 4 of each commodity storage 2. Within the commodity storage 2, internal air is circulated by the fan 5 and cooled by the cooling unit 4. Each of the electromagnetic valves 7*a* of the refrigerating circuit 7 is individually controlled by the control section 8 with reference to the detected temperature of the commodity storage 2 corresponding thereto so that the interior of the commodity storage 2 is kept at a preselected storage temperature. In each commodity storage 2, a cooling operation is controllably carried out in the following manner. When the electromagnetic valve 7*a* is opened, the cool refrigerant passes through the cooling unit 4 to carry out the cooling operation. On the other hand, when the electromagnetic valve 7*a* is closed, the cool refrigerant does not pass through the cooling unit 4 to suspend the cooling operation. If all of the electromagnetic valves 7*a* are closed, the compressor 7*b* of the refrigerating circuit 7 is also stopped.

The above-mentioned automatic vending machine carries out a defrosting operation in which the cooling operation by the cooling unit 4 is stopped and the fan 5 is continuously operated. The defrosting operation is carried out for a defrosting time period at a predetermined defrosting interval. The defrosting time period is variable in length under control of the control section 8 in the manner which will be described in the following. On carrying out the defrosting operation, the fan 5 is referred to as a defrosting unit. On controlling the defrosting operation, the control section 8 is referred to as a defrost control part.

Figure 3:
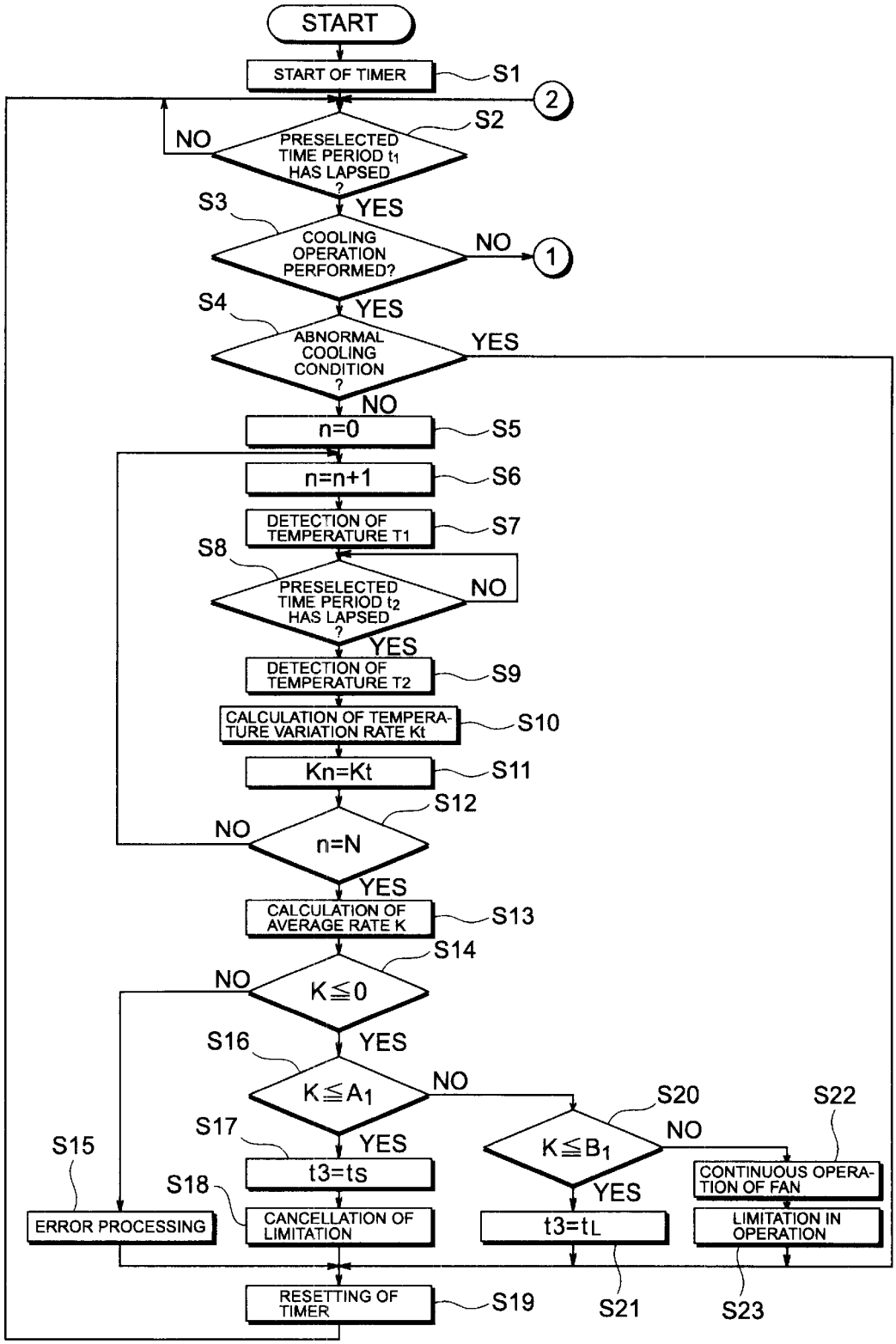
FIG. 3 is a flow chart for describing a part of an operation of the control section illustrated in FIG. 2.
Figure 4:
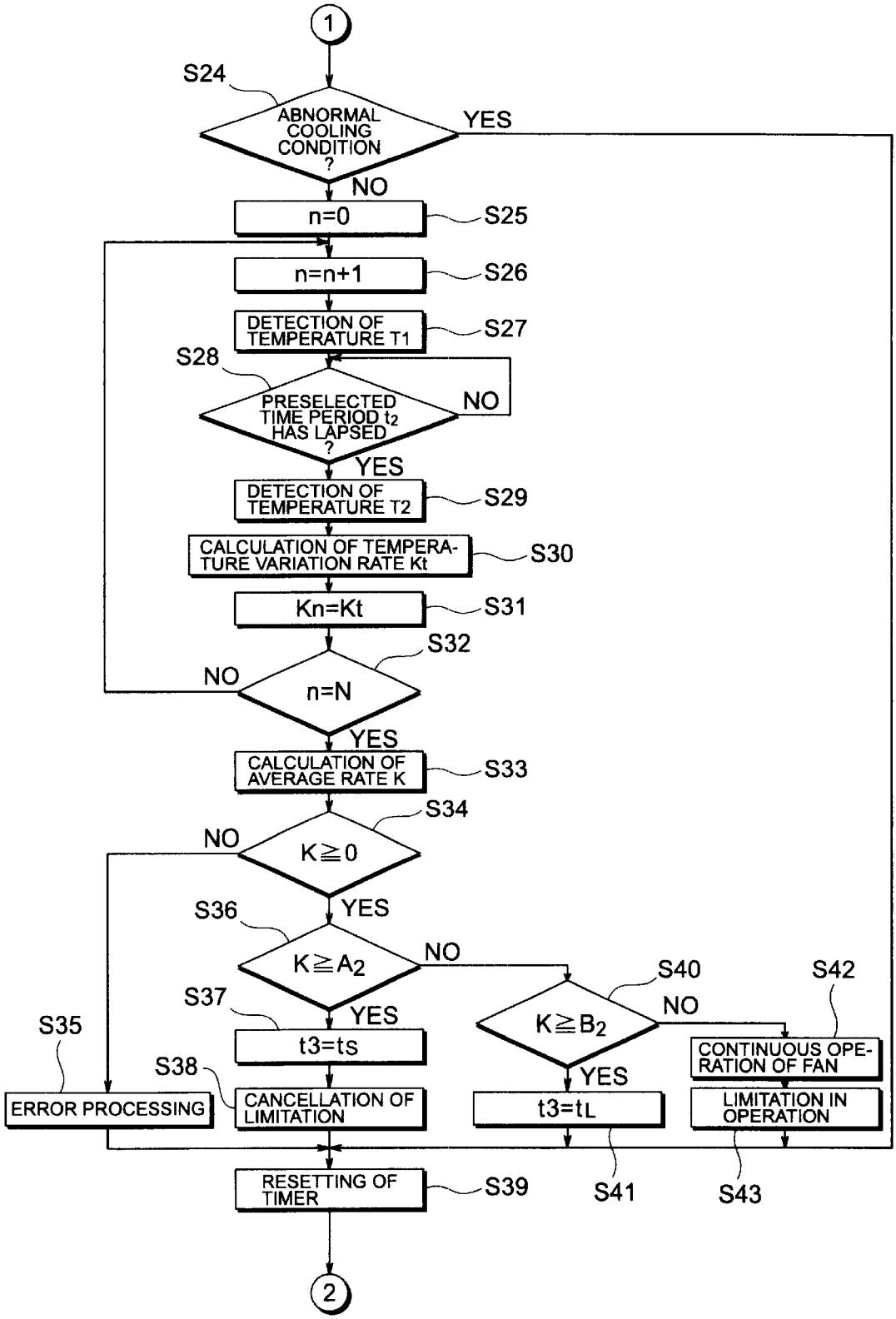
FIG. 4 is a flow chart for describing another part of the operation of the control section illustrated in FIG. 2.

Referring to FIGS. 3 and 4 in addition, an operation of the control section 8 will be described.

At first referring to FIG. 3, the timer 8*b* of the control section 8 starts monitoring of time (step S1). After lapse of a preselected time period t1 (yes in step S2), judgment is made about whether or not the cooling operation is carried out in the commodity storage 2 (step S3). If the cooling operation is performed, i.e., the electromagnetic valve 7*a* is opened (yes in step S3), judgment is made about whether or not a cooling condition is abnormal (step S4). If the cooling condition is not abnormal (no in step S4), a repeat count n (n=0, 1, 2, . . . ) representative of the number of times of calculation is initialized to zero (step S5). Then, one is added to the repeat count n (step S6). Thereafter, the temperature sensor 6 detects a storage temperature within the commodity storage 2 as a first detected storage temperature T1 (step S7). Next, judgment is made about whether or not a preselected time period t2 has lapsed (step S8). After lapse of the preselected time period t2 (yes in step S8), the temperature sensor 6 detects a storage temperature as a second detected storage temperature T2 (step S9). From the first and the second detected storage temperatures T1 and T2 and the preselected time period t2, a temperature variation rate Kt is calculated (step S10). Thus, the temperature variation rate Kt is given by:

$$Kt=(T2-T1)/t2$$

The temperature variation rate Kt calculated at an n-th cycle is represented by an n-th temperature variation rate Kn (step S11). Judgment is made about whether or not the repeat count n reaches a predetermined number N (step S12). If the repeat count n does not reach the predetermined number N (no in step S12), the steps S6 through S11 are repeated until the repeat count n reaches the predetermined number N (yes in step S12). Thus, the first through the N-th temperature variation rates K1 through KN calculated in the first through the N-th cycles are obtained. In this event, the calculating unit 8*c* is operable as a first calculating part which is for calculating a predetermined number of variation rates of temperature per unit time.

Then, an average temperature variation rate K of the first through the N-th temperature variation rates K1 through KN is calculated (step S13). In this event, the calculating unit 8*c* is operable as a second calculating part which is for calculating an average value of the variation rates.

Based on the average temperature variation rate K, following judgments are carried out. At first, judgment is made about whether or not the average temperature variation rate K is equal to or smaller than zero (step S14). If the average temperature variation rate K is greater than zero (no in step S14), this means that the storage temperature within the commodity storage 2 is increased although the cooling operation is performed. In this event, an abnormal cooling condition such as a failure in the compressor 7*b* or the electromagnetic valve 7*a* is supposed. Supposing the abnormal cooling condition, a predetermined error processing operation (for example, suspension of a vending operation from the commodity storage 2 in consideration) is carried out (step S15). Thereafter, the timer 8*b* is reset (step S19) and the operation returns to the step S2.

If it is judged in the step S14 that the average temperature variation rate K is not greater than zero (yes in step S14), the average temperature variation rate K is then compared with lower and higher reference values A1 and B1 (A1<B1<0) preliminarily given. At first, judgment is made about whether or not the average temperature variation rate K is equal to or smaller than the lower reference value A1 (step S16). If the average temperature variation rate K is equal to or smaller than the lower reference value A1 (yes in step S16), it is judged that a very little amount of frost or no frost is accumulated in the cooling unit 4 because the temperature drop is quick. Therefore, from predetermined shorter and longer time periods tS and tL (tS<tL), the predetermined shorter time period tS is selected as a defrosting time period t3 (step S17). If any limitation in operation (which will later be described) is imposed, such limitation is cancelled (step S18). The timer 8*b* is reset (step S19). Then, the operation returns to the step S2.

If it is judged in the step S16 that the average temperature variation rate K is greater than the lowerr reference value A1 (no in step S16), judgment is made about whether or not the average temperature variation rate K is equal to or smaller than the higher reference value B1 (step S20). If the average temperature variation rate K is equal to or smaller than the higher reference value B1 (yes in step S20), it is judged that a moderate amount of frost is accumulated in the cooling unit 4 because the temperature drop is slow. Therefore, the predetermined longer time period tL is selected as the defrosting time period t3 (step S21). The timer 8*b* is reset (step S19). Then, the operation returns to the step S2.

If it is judged in the step S20 that the average temperature variation rate K is greater than the higher reference value B1 (no in step S20), it is judged that the amount of frost accumulated in the cooling unit 4 is too large to maintain the storage temperature within the commodity storage 2 because no substantial temperature drop is caused. Therefore, the fan 5 is continuously operated (step S22) and the limitation in operation (for example, the vending operation from the commodity storage 2 in consideration is suspended and the cooling operation is regulated by keeping the electromagnetic valve 7*a* in a closed state) is imposed (step S23). Thereafter, the timer 8*b* is reset (step S19). The operation returns to the step S2. The above-mentioned limitation in operation is cancelled in the step S18 if the cooling unit 4 is defrosted by the continuous operation of the fan 5 and the average temperature variation rate K becomes equal to or smaller than the lower reference value A1 in the step S16. On carrying out the steps S22 and S23, the control section 8 will be referred to as an operation limiting part. On carrying out the step S18, the control section 8 will be referred to as a limitation canceling part.

Next referring to FIG. 4, description will be made about the case where it is judged in the step S3 that the cooling operation is suspended (i.e., the electromagnetic valve 7*a* is closed). In this event, judgment is made about whether or not the cooling condition is abnormal (step S24). If the cooling condition is not abnormal (no in step S24), calculation of the average temperature variation rate K in steps S25 through S33 are performed. Herein, the steps S25 through S33 are similar to the above-mentioned steps S5 through S13 and, therefore, will not be described any longer.

Based on the average temperature variation rate K, following judgments are carried out. At first, judgment is made about whether or not the average temperature variation rate K is equal to or greater than zero (step S34). If the average temperature variation rate K is smaller than zero (no in step S14), this means that the storage temperature within the commodity storage 2 is decreased although the cooling operation is suspended. In this event, an abnormal cooling condition such as a failure in the electromagnetic valve 7*a* is supposed. Supposing the abnormal cooling condition, a predetermined error processing operation is carried out (step S35). Thereafter, the timer 8*b* is reset (step S39) and the operation returns to the step S2.

If it is judged in the step S34 that the average temperature variation rate K is equal to or greater than zero (yes in step S34), the average temperature variation rate K is then compared with higher and lower reference values A2 and B2 (A2>B1>0) preliminarily given. At first, judgment is made about whether or not the average temperature variation rate K is equal to or greater than the higher reference value A1 (step S36). If the average temperature variation rate K is equal to or greater than the higher reference value A2 (yes in step S36), it is judged that a very little amount of frost or no frost is accumulated in the cooling unit 4 because the temperature increase is quick. Therefore, from the predetermined shorter and the predetermined longer time periods tS and tL (tS<tL), the predetermined shorter time period tS is selected as the defrosting time period t3 (step S37). If the limitation in operation is imposed, such limitation is cancelled (step S38). The timer 8*b* is reset (step S39). Then, the operation returns to the step S2.

If it is judged in the step S36 that the average temperature variation rate K is smaller than the higher reference value A2 (no in step S36), judgment is made about whether or not the average temperature variation rate K is equal to or greater than the lower reference value B2 (step S40). If the average temperature variation rate K is equal to or greater than the lower reference value B2 (yes in step S40), it is judged that a moderate amount of frost is accumulated in the cooling unit 4 because the temperature increase is slow. Therefore, the longer predetermined time period tL is selected as the defrosting time period t3 (step S41). The timer 8*b* is reset (step S39). Then, the operation returns to the step S2.

If it is judged in the step S40 that the average temperature variation rate K is smaller than the lower reference value B2 (no in step S40), it is judged that the amount of frost accumulated in the cooling unit 4 is too large to maintain the storage temperature within the commodity storage 2 because no substantial temperature increase is caused. Therefore, the fan 5 is continuously operated (step S42) and the above-mentioned limitation in operation is imposed (step S43). Thereafter, the timer 8*b* is reset (step S39). The operation returns to the step S2. The above-mentioned limitation in operation is cancelled in the step S38 if the cooling unit 4 is defrosted by the continuous operation of the fan 5 and the average temperature variation rate K becomes equal to or greater than the higher reference value A2 in the step S36.

In the above-mentioned automatic vending machine, calculation is made of the average temperature variation rate K prior to the defrosting operation by the use of the first and the second detected storage temperatures T1 and T2. Based on the average temperature variation rate K, the length of a next defrosting time period is controlled. Thus, the defrosting operation adapted to the frosting condition is always carried out to thereby prevent insufficient defrosting or an excessive defrosting operation with high reliability. Since the calculation of the temperature variation rate Kt is carried out a plurality of number of times and the average temperature variation rate K is obtained, accurate control is assured even if the temperature variation in the commodity storage 2 is nonuniform. If the limitation in operation, such as suspension of the vending operation, is imposed because it is judged from the average temperature variation rate K that the amount of frost is so large, such limitation in operation is cancelled if it is judged from the average temperature variation rate K later calculated that the frost is sufficiently removed. Thus, during suspension of the vending operation under the limitation in operation, a vendable condition is automatically recovered without any special repair work. This lessens the load upon an administrator of the automatic vending machine.

The preselected time period t1 as the predetermined defrosting interval, the preselected time period t2 between detection time instants of the first and the second detected storage temperatures T1 and T2, the repeat count N of calculation of the temperature variation rate Kt, and the reference values A1, A2, B1, and B2 may be set to desired values by the setting unit 9. In this event, adaptive control can be performed in dependence upon various conditions related to the installation and the use of the automatic vending machine. In this case, the reference values A1, A2, B1, and B2 may be given as desired values or may be calculated in the calculating unit 8*c* from predetermined conditions related to the commodity storage 2, for example, the volume of the commodity storage 2 or the condition of a next adjacent commodity storage 2 (if the cooling operation or the heating operation is performed). Alternatively, each of the reference values A1, A2, B1, and B2 may be selected from a set value given as the desired value and a calculated value calculated from the conditions related to the commodity storage 2. On setting the preselected time interval t1, the setting unit 9 is operable as a suspension time setting part. On setting the preselected time period t2, the setting unit 9 is operable as a unit time setting part. On setting the repeat count N, the setting unit 9 is operable as a number setting part. On setting the reference values A1, A2, B1, and B2, the setting unit 9 is operable as a reference value setting part. On setting the desired value, the setting unit 9 is operable as a desired value setting part. On calculating the reference values A1, A2, B1, and B2, the calculating unit 8*c* is operable as a value calculating part. On calculating the reference values A1, A2, B1, and B2 based on the predetermined conditions related to the commodity storeges 2, the calculating unit 8*c* is operable as a local calculating part.

Furthermore, based on the result of comparison between the average temperature variation rate K calculated by the control section 8 and the reference values A1 and B1 for the cooling operation, the compressor 7*b* in the refrigerating circuit 7 or the fan 5 can be controlled during the cooling operation. For example, if it is judged in the comparison with the reference value A1 or B1 that the temperature drop is slow, this may result from a low ability of the compressor 7*b* or the fan 5 in addition to the accumulation of frost in the cooling unit 4. Therefore, the working ratio of the compressor 7*b* or the rotation speed of the fan 5 is controllably increased. If the temperature drop rate is increased as a result of such control, the defrosting operation is prevented from being carried out for an excessively long time. Thus, the defrosting time period can be more properly controlled. On carrying out a comparison operation between the temperature variation rate Kt with the reference values A1 and B1, the control unit 8 is operable as a comparing part. On controlling an operation of the compressor 7*b* and the fan 5, the control unit 8 is operable as a local control part.

While the present invention has thus far been described in connection with a few embodiments thereof, it will readily be possible for those skilled in the art to put this invention into practice in various other manners. For example, although the temperature variation rate is calculated a plurality of times and the average temperature variation rate is obtained, the control may be carried out based on the temperature variation rate calculated only once.

What is claimed is:

1. An automatic vending machine comprising:

a commodity storage for storing a number of items to be sold;

a refrigerating circuit having a cooling unit connected to said commodity storage for cooling said items;

a defrosting unit connected to said cooling unit for intermittently carrying out a defrosting operation for said cooling unit;

a temperature sensor connected to said commodity storage for detecting a storage temperature within said commodity storage to produce a temperature signal;

a calculating unit connected to said temperature sensor and responsive to said temperature signal for calculating a temperature variation rate prior to said defrosting operation; and a defrost control part connected to said calculating unit and said defrosting unit for controlling said defrosting operation with reference to said temperature variation rate;

wherein said calculating unit comprises:

a first calculating part connected to said temperature sensor and responsive to said temperature signal for calculating a predetermined number of variation rates of temperature per unit time; and a second calculating part connected to said first calculating part and said defrost control part for calculating an average value of said variation rates to supply said average value as said temperature variation rate to said defrost control part; and said automatic vending machine further comprising a unit time setting part connected to said first calculating part for setting said unit time.

2. An automatic vending machine as claimed in claim 1, further comprising:

an operation limiting part connected to said refrigerating circuit for limiting a predetermined operation of said automatic vending machine; and a limitation canceling part connected to said calculating unit and said operation limiting part for canceling a limitation of said predetermined operation when said temperature variation rate is not smaller than a predetermined rate.

3. An automatic vending machine as claimed in claim 1, wherein said defrosting unit carries out said defrosting operation at a preselected time interval for a preselected time period, said defrost limiting part controlling said predetermined time period.

4. An automatic vending machine as claimed in claim 3, further comprising a suspension time setting part connected to said defrosting unit for setting said preselected time interval.

5. An automatic vending machine as claimed in claim 1, further comprising a number setting part for setting said predetermined number.

6. An automatic vending machine as claimed in claim 1, further comprising a cooling control part connected to said refrigerating circuit and said calculating unit for controlling an operation of said refrigerating circuit in response to said temperature variation rate.

7. An automatic vending machine comprising:

a commodity storage for storing a number of items to be sold;

a refrigerating circuit having a cooling unit connected to said commodity storage for cooling said items;

a defrosting unit connected to said cooling unit for intermittently carrying out a defrosting operation for said cooling unit;

a temperature sensor connected to said commodity storage for detecting a storage temperature within said commodity storage to produce a temperature signal;

a calculating unit connected to said temperature sensor and responsive to said temperature signal for calculating a temperature variation rate prior to said defrosting operation; and a defrost control part connected to said calculating unit and said defrosting unit for controlling said defrosting operation with reference to said temperature variation rate; and wherein said defrost control part comprises:

a comparing part connected to said calculating unit for carrying out a comparison operation between said temperature variation rate with a reference value; and a local control part connected to said comparing part and said defrosting unit for controlling an operation of said defrosting unit in response to a result of said comparison operation.

8. An automatic vending machine as claimed in claim 7, wherein said calculating unit comprises:

a first calculating part connected to said temperature sensor and responsive to said temperature signal for calculating a predetermined number of variation rates of temperature per unit time; and a second calculating part connected to said first calculating part and said defrost control part for calculating an average value of said variation rates to supply said average value as said temperature variation rate to said defrost control part.

9. An automatic vending machine as claimed in claim 7, further comprising a reference value setting part connected to said defrost control part for setting said reference value to supply said reference value to said defrost control part.

10. An automatic vending machine as claimed in claim 7, further comprising a local calculating part connected to said defrost control part for calculating said reference value based on predetermined conditions related to said commodity storage to supply said reference value to said defrost control part.

11. An automatic vending machine as claimed in claim 7, further comprising:

a desired value setting part for setting a desired value related to said temperature variation rate;

a value calculating part for calculating a calculated value based on predetermined conditions related to said commodity storage; and a value selecting part connected to said desired value setting part, said value calculating part, and said defrost control part for selecting, as said reference value, one of said desired and said calculated values to supply said reference value to said defrost control part.

12. An automatic vending machine as claimed in claim 7, further comprising a cooling control part connected to said refrigerating circuit and said calculating unit for controlling an operation of said refrigerating circuit in response to said temperature variation rate.

* * * * *